US010323815B2

(12) United States Patent
Li

(10) Patent No.: US 10,323,815 B2
(45) Date of Patent: Jun. 18, 2019

(54) REAR-LOADING CLIP FOR A LIGHT MODULE

(71) Applicant: Valeo North America, Inc., Troy, MI (US)

(72) Inventor: Ziyi Li, Columbus, IN (US)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 15/727,954

(22) Filed: Oct. 9, 2017

(65) Prior Publication Data

US 2019/0107266 A1 Apr. 11, 2019

(51) Int. Cl.

| | |
|---|---|
| ***F21V 13/04*** | (2006.01) |
| ***F21S 41/29*** | (2018.01) |
| ***F21V 17/06*** | (2006.01) |
| ***F21V 17/16*** | (2006.01) |
| ***F21S 43/27*** | (2018.01) |

(52) U.S. Cl.

CPC ..... *F21S 41/29* (2018.01); *F21S 43/27* (2018.01); *F21V 17/06* (2013.01); *F21V 17/164* (2013.01)

(58) Field of Classification Search

CPC ..... F21S 41/29; F21S 43/27; F21V 17/06; F21V 17/164

USPC ..... 362/520

See application file for complete search history.

(56) References Cited

U.S. PATENT DOCUMENTS

| | | | | |
|---|---|---|---|---|
| 4,532,577 | A * | 7/1985 | Shelton | B60Q 1/2638 362/307 |
| 6,350,043 | B1 | 2/2002 | Gloisten | |
| 2007/0263400 | A1 | 11/2007 | Walser et al. | |
| 2015/0266408 | A1 | 9/2015 | Leang | |
| 2016/0097506 | A1 | 4/2016 | Soenen et al. | |
| 2016/0362042 | A1 | 12/2016 | Ovenshire et al. | |

* cited by examiner

*Primary Examiner* — Karl D Frech

(74) *Attorney, Agent, or Firm* — Oblon, McClelland, Maier & Neustadt, L.L.P.

(57) ABSTRACT

An inner lens for a light module includes a first plurality of clips positioned on a lower surface of the inner lens configured to engage with a corresponding first plurality of protrusions of a light frame module; and a second plurality of clips positioned on an upper surface of the inner lens configured to engage with a corresponding second plurality of protrusions of the light frame module. The inner lens is configured to be mounted to the light frame module from a rear side of the light frame module.

17 Claims, 7 Drawing Sheets

REAR-LOADING CLIP FOR A LIGHT MODULE

BACKGROUND

In many conventional vehicle designs, an inner lens is attached or mounted to a light frame module, such as a bezel. However, the clips or fasteners by which the inner lens is attached to the light frame module remain exposed to the exterior environment because the inner lens is mounted to the light frame module from the front side. Therefore, "cover up" methods are needed, which include a black-shot molding onto the inner lens or hiding the fasteners or clips behind a second bezel. These solutions may not be feasible with a limited packaging space.

The "background" description provided herein is for the purpose of generally presenting the context of the disclosure. Work of the presently named inventors, to the extent it is described in this background section, as well as aspects of the description which may not otherwise qualify as conventional art at the time of filing, are neither expressly nor impliedly admitted as conventional art against the present disclosure.

SUMMARY

Embodiments described herein include the following aspects.

(1) An inner lens for a light module includes a first plurality of clips positioned on a lower surface of the inner lens configured to engage with a corresponding first plurality of protrusions of a light frame module; and a second plurality of clips positioned on an upper surface of the inner lens configured to engage with a corresponding second plurality of protrusions of the light frame module. The inner lens is configured to be mounted to the light frame module to a rear back side of the light frame module.

(2) The inner lens of (1), wherein each of the first plurality of clips has a U-shaped extended end with a hollow central region configured to receive a respective first protrusion of the first plurality of protrusions of the light frame module.

(3) The inner lens of either (1) or (2), wherein the U-shaped extended end of said each of the first plurality of clips is configured to bend and lock the first protrusion into place after fully receiving the first protrusion of the first plurality of protrusions.

(4) The inner lens of any one of (1) through (3), wherein the first plurality of clips is configured to fully engage with the first plurality of protrusions simultaneously.

(5) The inner lens of any one of (1) through (4), wherein each of the first plurality of clips is formed as an integral component of the inner lens.

(6) The inner lens of any one of (1) through (5), wherein each of the first plurality of clips is made of a flexible material relative to the inner lens.

(7) The inner lens of any one of (1) through (6), wherein each of the second plurality of clips has a first extended end with a first hollow central region.

(8) The inner lens of any one of (1) through (7), wherein each of the second plurality of clips further includes a second extended end with a second hollow central region, and wherein the second extended end extends into the first hollow central region.

(9) The inner lens of any one of (11) through (8), wherein each of the second hollow central regions of the second plurality of clips is configured to receive a respective second protrusion of the second plurality of protrusions of the light frame module.

(10) The inner lens of any one of (1) through (9), wherein the second extended end of said each of the second plurality of clips is configured to bend and lock the second protrusion into place within the second hollow central region after fully receiving the second protrusion of the second plurality of protrusions within the second hollow central region.

(11) The inner lens of any one of (1) through (10), wherein the second plurality of clips is configured to fully receive the second plurality of protrusions simultaneously within the respective second hollow central regions.

(12) The inner lens of any one of (1) through (11), wherein each of the second plurality of clips is formed as an integral component of the inner lens.

(13) The inner lens of any one of (1) through (12), wherein each of the first extended ends of the second plurality of clips is made of a rigid material relative to the inner lens.

(14) The inner lens of any one of (1) through (13), wherein each of the second extended ends of the second plurality of clips is made of a flexible material relative to the first extended ends of the second plurality of clips.

(15) The inner lens of any one of (1) through (14), wherein the first plurality of clips differs from the second plurality of clips.

(16) The inner lens of any one of (1) through (15), wherein the upper surface of the inner lens includes one or more of the first plurality of clips and one or more of the second plurality of clips.

(17) The inner lens of any one of (1) through (16), wherein the lower surface of the inner lens includes one or more of the first plurality of clips and one or more of the second plurality of clips.

(18) The inner lens of any one of (1) through (17), wherein the light frame module comprises a bezel.

(19) The inner lens of any one of (1) through (18), wherein the first plurality of clips and the second plurality of clips are not visible from the exterior of the light module when the inner lens is mounted to the light module.

(20) The inner lens of any one of (1) through (19), wherein a first number of the first plurality of clips and a second number of the second plurality of clips positioned on the inner lens are determined to meet or exceed a vibration validation standard.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

The following descriptions are meant to further clarify the present disclosure by giving specific examples and embodiments of the disclosure. These embodiments are meant to be illustrative rather than exhaustive. The full scope of the disclosure is not limited to any particular embodiment disclosed in the specification, but rather is defined by the claims.

In the interest of clarity, not all of the features of the implementations described herein are shown and described in detail. It will be appreciated that in the development of any such actual implementation, numerous implementation-specific decisions will be made in order to achieve the developer's specific goals, such as compliance with application- and business-related constraints, and that these specific goals will vary from one implementation to another and from one developer to another.

Embodiments described herein provide lighting modules having one or more solid state light sources. As used herein, a solid state light source refers to a type of light source using an electroluminescence phenomenon in which a material emits light in response to passage of an electric current or in response to a strong electric field. Examples of light sources include, but are not limited to semiconductor light-emitting diodes (LEDs), organic light-emitting diodes (OLEDs), polymer light-emitting diodes (PLEDs), and monolithic light-emitting diodes (MLEDs). Lighting modules described herein can also include one or more bulb sources, such as a halogen light source or a high intensity discharge (HID) light source.

Figure 1:
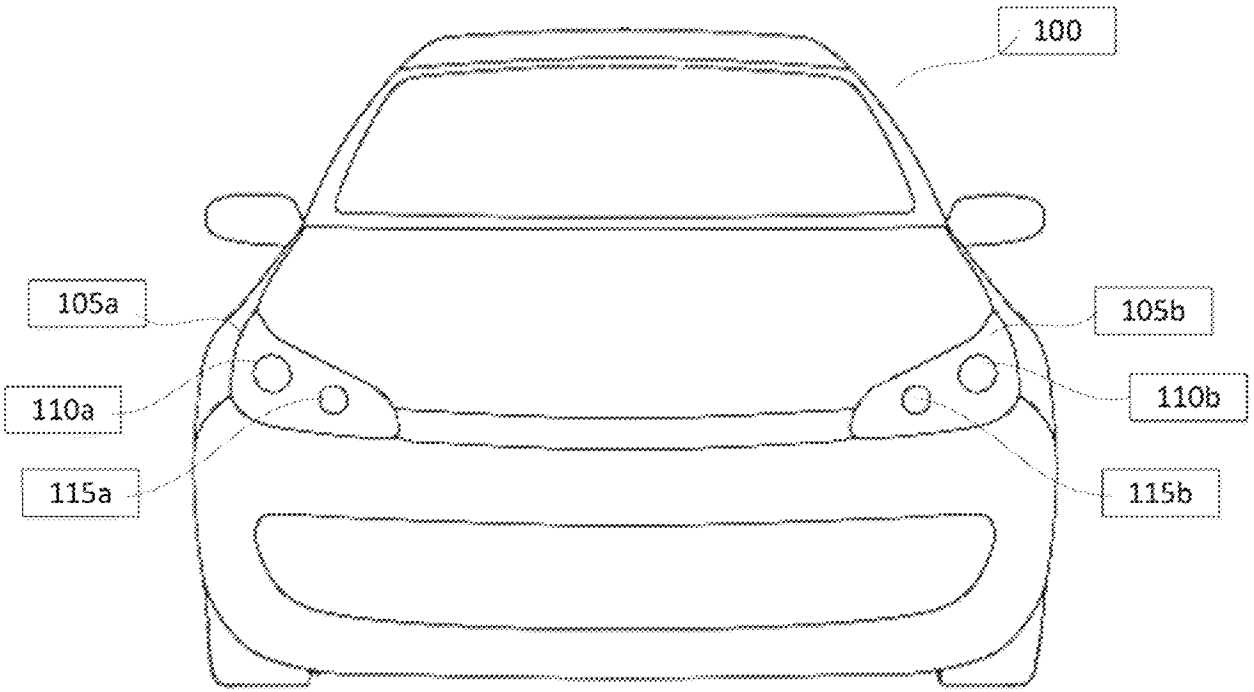
FIG. 1 illustrates a front-end of an exemplary motor vehicle according to one embodiment.

FIG. 1 illustrates a front-end of an exemplary motor vehicle 100. Motor vehicle 100 includes two headlamp assemblies 105*a* and 105*b*. Headlamp assemblies 105*a* and 105*b* include low beam headlamps 110*a* and 110*b* (also referred to as a lower or dipped beam) and high beam headlamps 115*a* and 115*b* (also referred to as a main or driving beam). Typically, the low beam headlamps 110*a* and 110*b* are used whenever another vehicle is on the road directly ahead of motor vehicle 100 and/or whenever another vehicle is approaching motor vehicle 100 from an opposite direction.

Figure 2:
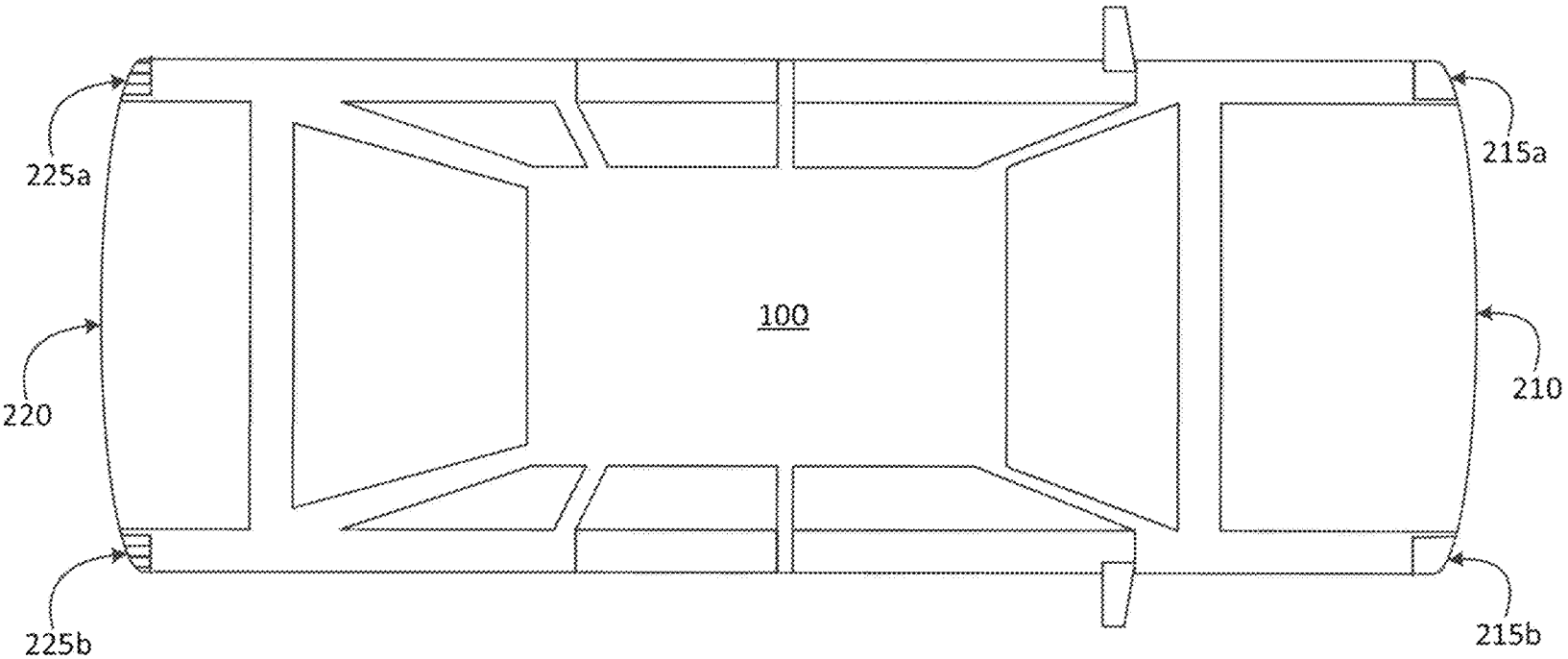
FIG. 2 illustrates a top view of a motor vehicle according to one embodiment.

FIG. 2 illustrates a top view of motor vehicle 100. A front end 210 and a back end 220 are illustrated. In addition to lighting functions, motor vehicle 100 illustrates signaling functions. Front lamp assemblies 215*a* and 215*b* represent signaling functions, such as a combination turn signal and parking lamp or a combination parking lamp and a daytime running lamp (DRL). Each of the front lamp assemblies 215*a* and 215*b* can be separate from headlamp assemblies 105*a* and 105*b* or they can be incorporated into the same assembly module.

FIG. 2 also illustrates rear lamp assemblies 225*a* and 225*b*. Rear lamp assemblies 225*a* and 225*b* represent signaling functions, such as a combination brake lamp and tail lamp or a combination tail lamp and a turn signal lamp. Each of the rear lamp assemblies 225*a* and 225*b* can include separate modules for each signaling lamp function or they can be incorporated into the same assembly module.

Most states, countries, or regions which utilize motor vehicles have various requirements and standards that a vehicle must adhere to in order to legally use roadways. For example, Federal Motor Vehicle Safety Standard (FMVSS) No. 108 specifies various maximum and minimum photometric intensity values (based on angle) for headlamps on vehicles operated within the Unites States. In addition to these requirements, the Insurance Institute for Highway Safety (IIHS) in the United States has its own set of tests and ratings (Headlight Test and Rating Protocol) for headlamp performance. The IIHS tests and ratings seek to encourage manufacturers to improve the illumination performance in actual on-road use. IIHS evaluations have shown that the on-road illumination provided by vehicle headlamps varies widely. In addition, IIHS has rated the majority of headlamps in a poor category (e.g. insufficient illumination, excessive glare, etc.).

Figure 3:
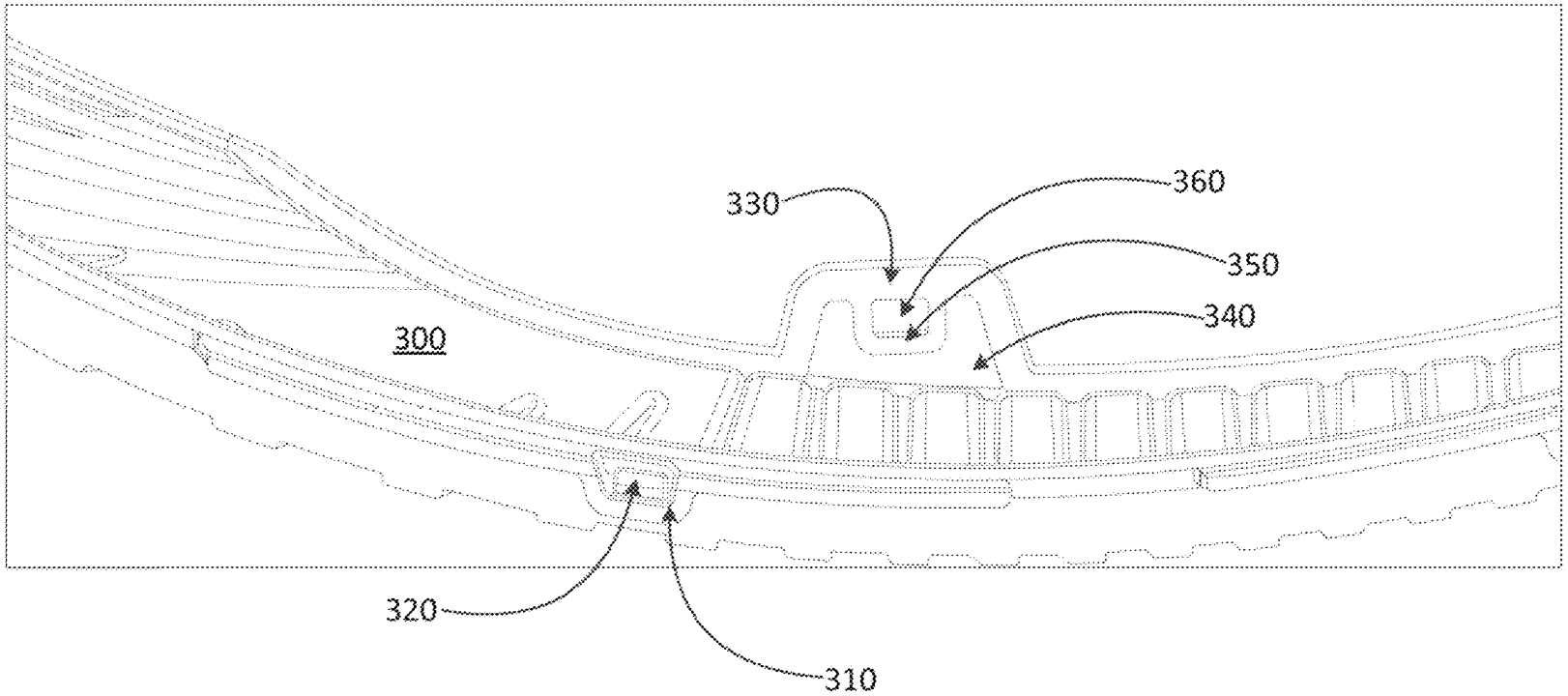
FIG. 3 illustrates a partial view of an inner lens for a light module according to one embodiment.

FIG. 3 illustrates a partial view of an inner lens 300 for a light module. A first clip 310 is positioned on a lower side of the inner lens 300. The first clip 310 has a hollow central region 320, which is configured to receive a first protrusion of a light frame module (illustrated in FIG. 5). The first clip 310 has a U-shape, wherein the two ends of the first clip 310 are formed as an integral component of the inner lens 300. The first clip 310 is made of a flexible material, relative to the inner lens 300. This allows the first clip 310 to flex/bend as the first protrusion is inserted into the hollow central region 320 of the first clip 310.

A second clip 330 is positioned on an upper side of the inner lens 300. The second clip 330 has a first extended end with a first hollow central region 340. The second clip 330 has a U-shape, wherein the two ends of the second clip 330 are formed as an integral component of the inner lens 300. The U-shaped portion of the second clip 330 is made of a rigid material, similar to or the same as the inner lens 300.

The second clip 330 also has a second extended end 350 which extends into the first hollow central region 340. The second extended end 350 is made of a flexible material, relative to the U-shaped portion of the second clip 330. The second extended end 350 has a second hollow central region 360, which is configured to receive a second protrusion from the light frame module.

Figure 4:
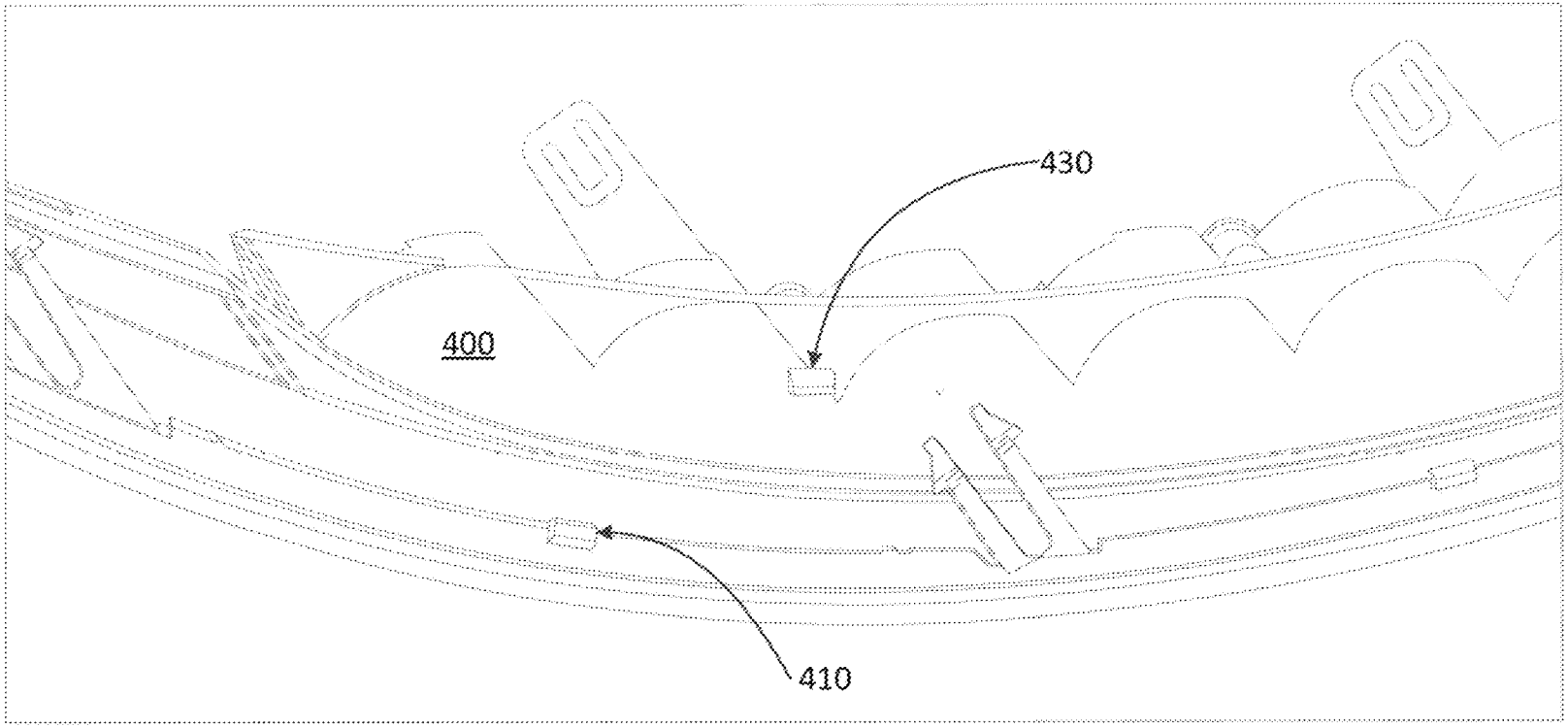
FIG. 4 illustrates an exemplary light frame module according to one embodiment.

The first clip 310 and the second clip 330 are configured to receive protrusions from a light frame module. FIG. 4 illustrates an exemplary light frame module 400, such as a bezel. A first protrusion 410, such as a bezel standoff is shaped and positioned on the light frame module 400, such that it engages with the first clip 310 from the inner lens 300. When the first protrusion 410 is inserted into the first hollow central region 340 of the first clip 310, the first clip 310 is pushed or flexed upward. When the first protrusion 410 is further inserted into the first hollow central region 340, the first clip 310 springs back to its original position and the first protrusion 410 becomes locked into place by the first clip 310.

FIG. 4 illustrates just one first protrusion 410 for simplicity. However, a plurality of first protrusions 410 are present on the light frame module 400, which are configured and positioned to engage with a corresponding plurality of first clips 310 on the inner lens 300. When the inner lens 300 is mounted to the light frame module 400, the plurality of first clips 310 are configured to fully engage with the plurality of first protrusions 410 simultaneously.

A second protrusion 430 is illustrated on the light frame module 400. The second protrusion 430 is shaped and positioned on the light frame module 400, such that it engages with the second clip 330 from the inner lens 300. When the second protrusion 430 is inserted into the second hollow central region 360 of the second clip 330, the second extended end 350 of the second clip 330 is pushed or flexed upward. When the second protrusion 430 is further inserted into the second hollow central region 360, the second extended end 350 of the second clip 330 springs back to its original position and the second protrusion 430 becomes locked into place by the second extended end 350 of the second clip 330.

FIG. 4 illustrates just one second protrusion 430 for simplicity. However, a plurality of second protrusions 430 are present on the light frame module 400, which are configured and positioned to engage with a corresponding plurality of second clips 330 on the inner lens 300. When the inner lens 300 is mounted to the light frame module 400, the plurality of second clips 330 are configured to fully engage with the plurality of second protrusions 430 simultaneously.

Figure 5:
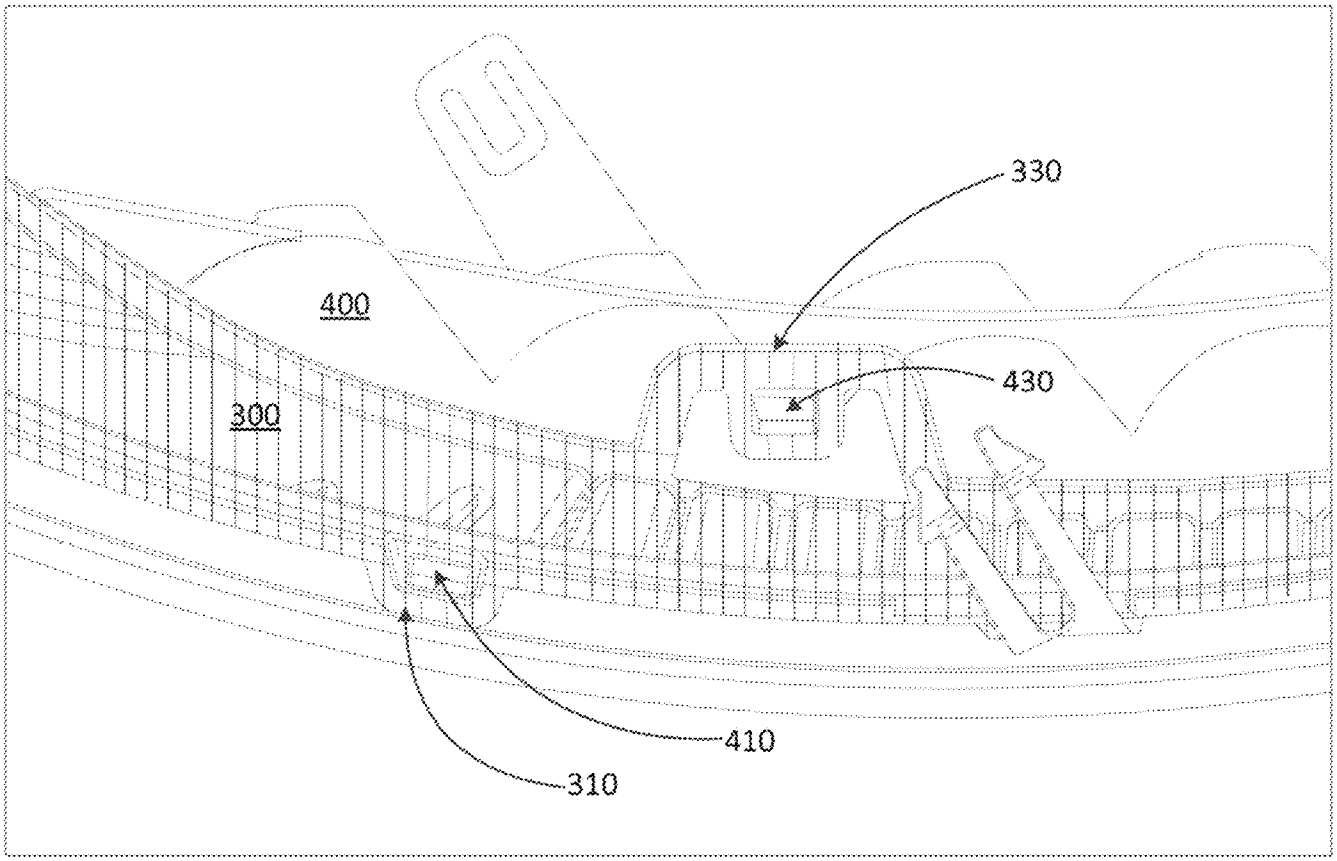
FIG. 5 illustrates a light module in which the inner lens is engaged with the light frame module according to one embodiment.

FIG. 5 illustrates a light module 500 in which the inner lens 300 is engaged with the light frame module 400. The first clip 310 of the inner lens 300 is fully engaged with the first protrusion 410 of the light frame module 40X). The second clip 330 of the inner lens 300 is fully engaged with the second protrusion 430 of the light frame module 400. Just one first clip 310 engaged with the first protrusion 410 and just one second clip 330 engaged with the second protrusion 430 are illustrated for simplicity. However, multiple first clips 310 are engaged with multiple first protrusions 410 and multiple second clips 330 are engaged with multiple second protrusions 430 when the inner lens 300 is fully engaged with the light frame module 400.

The number of first clips 310 engaged with corresponding first protrusions 410 and the number of second clips 330 engaged with corresponding second protrusions 430 can depend in part on adequately securing the inner lens 300 with the light frame module 400, such that vibrations are eliminated. In one embodiment, the numbers of first clips 310 and the numbers of second clips 330 are determined such that a vibration validation standard is met or exceeded.

Figure 6:
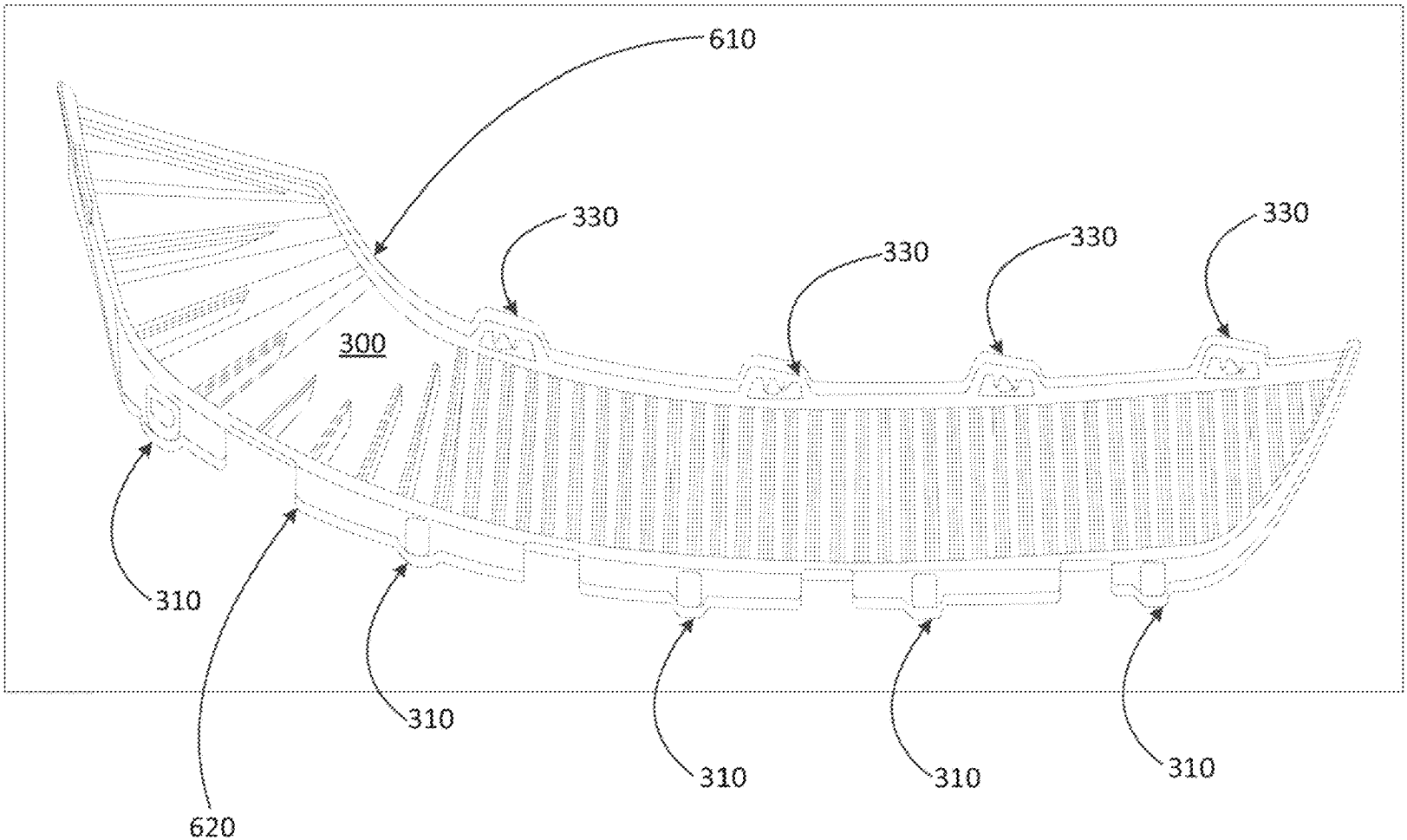
FIG. 6 illustrates a complete inner lens and an exemplary placement of first clips and second clips according to one embodiment.

FIG. 6 illustrates a complete inner lens 300 and an exemplary placement of first clips 310 and second clips 330. FIG. 6 illustrates six first clips 310 and four second clips 330. However, this is illustrated as just one example. There could be the same number of first clips 310 and second clips 330, or there could be fewer first clips 310 than second clips 330. The number of first clips 310 and the number of second clips 330 can vary with each particular type and design of inner lens 300 and light frame module 400.

In other examples, there can be a mixture of first clips 310 and second clips 330 on an upper surface 610 of the inner lens 300 and/or a mixture of first clips 310 and second clips 330 on a lower surface 620 of the inner lens 300. The number and placement of first clips 310 and second clips 330 can vary with each particular type and design of inner lens 300 and light frame module 400, and/or the number and placement can vary to achieve a vibration validation standard.

Light module 500 can be used for any vehicle lamps or reflectors, such as front lamp assemblies 215*a* and 215*b* and/or rear lamp assemblies 225*a* and 225*b*.

Figure 7:
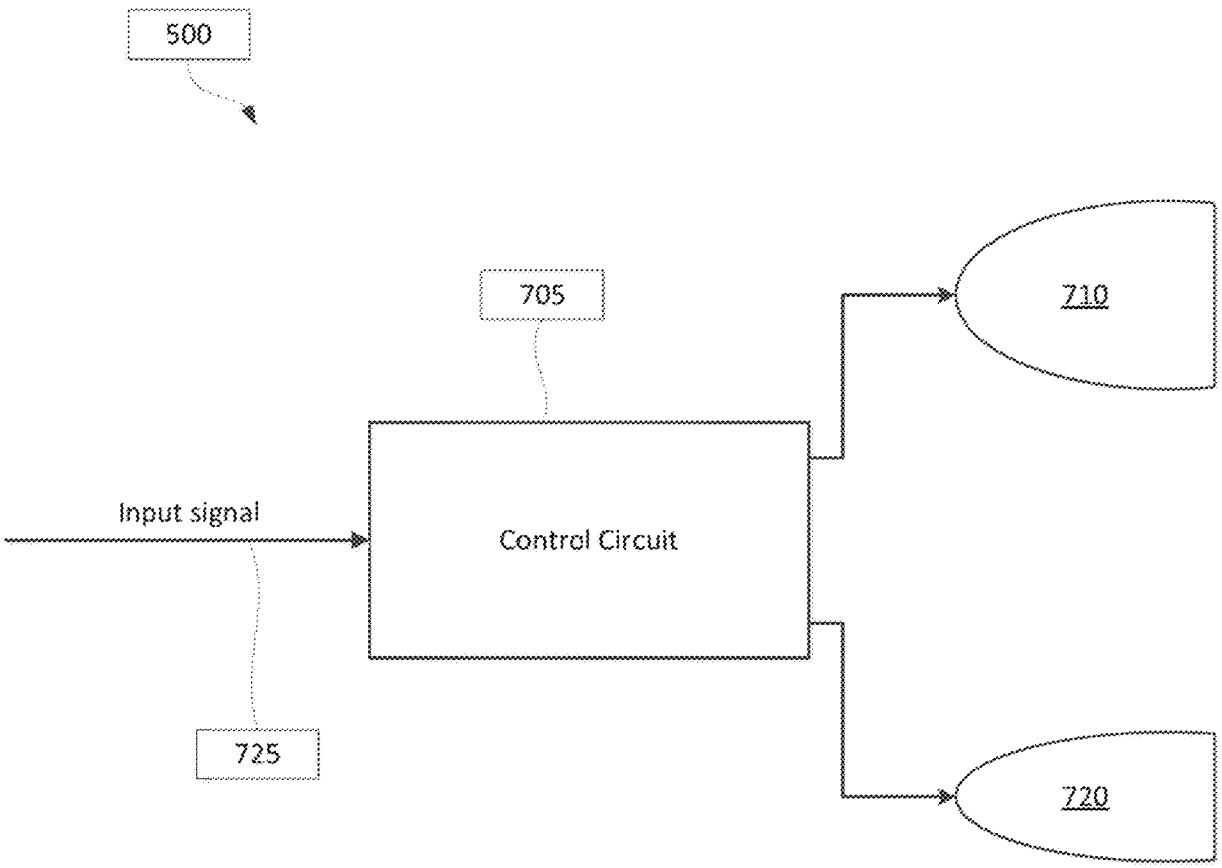
FIG. 7 illustrates a functional block diagram of a vehicle lamp assembly according to one embodiment.

FIG. 7 illustrates a functional block diagram of a vehicle lamp assembly 500 of vehicle 100. Vehicle lamp assembly 500 includes a control circuit 705 and a solid state light source module 710. One or more optional light source modules 720 include additional solid state light source modules and/or a laser light source module. An input signal 725 is connected to the control circuit 705. The input signal 725 can be a switch to initiate or close power to one or more of the solid state light source module 710 and the optional light source module(s) 720. Other types of input signals 725 are contemplated by embodiments described herein.

It should be noted that while FIG. 7 illustrates control circuit 705 as included within vehicle lamp assembly 500, control circuit 705 could also be located apart from vehicle lamp assembly 500. Moreover, a single control circuit 705 can be employed for both a right and left vehicle lamp assembly such that the solid state light source module 710 and the optional light source module(s) 720 are driven in a synchronized manner.

Embodiments described herein provide several advantages. The inner lens 310 is designed in such a way that it can be mounted to a rear back side, i.e. the interior unexposed side of the light frame module 400. This is advantageous because the first clips 310 and the second clips 330, as well as the respective first protrusions 410 and second protrusions 430 are hidden from an exterior view of the light module 500 when the light module 500 is mounted onto a vehicle. In addition, the first clips 310 and the second clips 330, as well as the respective first protrusions 410 and second protrusions 430 are compact and therefore, can fit into a small profile light module 500.

While certain embodiments have been described herein, these embodiments are presented by way of example only, and are not intended to limit the scope of the disclosure. Using the teachings in this disclosure, a person having ordinary skill in the art can modify and adapt the disclosure in various ways, making omissions, substitutions, and/or changes in the form of the embodiments described herein, without departing from the spirit of the disclosure. Moreover, in interpreting the disclosure, all terms should be interpreted in the broadest possible manner consistent with the context. The accompanying claims and their equivalents are intended to cover such forms or modifications, as would fall within the scope and spirit of the disclosure.

The invention claimed is:

1. An inner lens for a light module, comprising:

a first plurality of clips positioned on a lower surface of the inner lens configured to engage with a corresponding first plurality of protrusions of a light frame module, and a second plurality of clips positioned on an upper surface of the inner lens configured to engage with a corresponding second plurality of protrusions of the light frame module, wherein the inner lens is configured to be mounted to the light frame module to a rear back side of the light frame module, wherein each of the first plurality of clips has a U-shaped extended end with a hollow central region, a respective first protrusion of the first plurality of protrusions of the light frame module is configured to project into the hollow central region, wherein each of the second plurality of clips has a first extended end with a first hollow central region, wherein each of the second plurality of clips further includes a second extended end with a second hollow central region, and wherein a respective second protrusion of the second plurality of protrusions of the light frame module is configured to project into each of the second hollow central regions of the second plurality of clips.

2. The inner lens of claim 1, wherein the U-shaped extended end of said each of the first plurality of clips is configured to bend and lock the first protrusion into place after fully receiving the first protrusion of the first plurality of protrusions.

3. The inner lens of claim 2, wherein the first plurality of clips is configured to fully engage with the first plurality of protrusions simultaneously.

4. The inner lens of claim 1, wherein each of the first plurality of clips is formed as an integral component of the inner lens.

5. The inner lens of claim 4, wherein each of the first plurality of clips is made of a flexible material relative to the inner lens.

6. The inner lens of claim 1, wherein the second extended end extends into the first hollow central region.

7. The inner lens of claim 6, wherein each of the second plurality of clips is formed as an integral component of the inner lens.

8. The inner lens of claim 7, wherein each of the first extended ends of the second plurality of clips is made of a rigid material relative to the inner lens.

9. The inner lens of claim 8, wherein each of the second extended ends of the second plurality of clips is made of a flexible material relative to the first extended ends of the second plurality of clips.

10. The inner lens of claim 1, wherein the second extended end of said each of the second plurality of clips is configured to bend and lock the second protrusion into place within the second hollow central region after fully receiving the second protrusion of the second plurality of protrusions within the second hollow central region.

11. The inner lens of claim 10, wherein the second plurality of clips is configured to fully receive the second plurality of protrusions simultaneously within the respective second hollow central regions.

12. The inner lens of claim 1, wherein the first plurality of clips differs from the second plurality of clips.

13. The inner lens of claim 1, wherein the upper surface of the inner lens includes one or more of the first plurality of clips and one or more of the second plurality of clips.

14. The inner lens of claim 1, wherein the lower surface of the inner lens includes one or more of the first plurality of clips and one or more of the second plurality of clips.

15. The inner lens of claim 1, wherein the light frame module comprises a bezel.

16. The inner lens of claim 1, wherein the first plurality of clips and the second plurality of clips are not visible from the exterior of the light module when the inner lens is mounted to the light module.

17. The inner lens of claim 1, wherein a first number of the first plurality of clips and a second number of the second plurality of clips positioned on the inner lens are determined to meet or exceed a vibration validation standard.

* * * * *